United States Patent [19]

Hüther et al.

[11] Patent Number: 4,478,790

[45] Date of Patent: Oct. 23, 1984

[54] METHOD AND APPARATUS FOR MANUFACTURING MOLDED ARTICLES OF ALLOYED MATERIAL

[75] Inventors: Werner Hüther; Axel Rossmann, both of Karlsfeld, Fed. Rep. of Germany

[73] Assignee: MTU Motoren-und Turbinen-Union Munchen GmbH, Munich, Fed. Rep. of Germany

[21] Appl. No.: 373,827

[22] Filed: May 3, 1982

[30] Foreign Application Priority Data

May 22, 1981 [DE] Fed. Rep. of Germany ..... 3120501

[51] Int. Cl.[3] ..... B22F 3/16

[52] U.S. Cl. ..... 419/54; 419/36; 419/37; 419/44; 419/53; 419/55; 419/58; 425/78

[58] Field of Search ..... 419/37, 38, 41, 48, 419/49, 44, 36, 19, 20, 53, 54, 55, 57, 58; 425/78

[56] References Cited

U.S. PATENT DOCUMENTS 2,593,943 4/1952 Wainer ..... 419/37

4,113,480 9/1978 Rivers ..... 419/38

OTHER PUBLICATIONS

Lenel, F. V.; *Powder Metallurgy, Principles and Applications,* 1980, pp. 329–333.

*Primary Examiner*—Stephen J. Lechart, Jr.

*Assistant Examiner*—Howard J. Locker

*Attorney, Agent, or Firm*—Alan H. Levine

[57] ABSTRACT

A method of manufacturing molded articles of metal alloys, especially of nickel-base alloys, chromium-base alloys, titanium-base alloys, and dispersion-hardened alloys. A powder of the alloy, or a blend of powders of alloy constituents, is mixed with one or more plastics, selected from thermoplastics, duroplastics, and internal lubricants to form an injectionable granulate compound, the plastic content amounting to about 30% to 50% by volume. The compound is prepared by dissolving the plastic in a solvent which will not attack the base material of the alloy, and by blending it with the metal powder, after which the solvent is evaporated. The injectionable granulate compound is then injection molded to form a molded article. By heat treatment at 600° C. or below in inert gas the plastic is eliminated from the molded article. The article is then sintered. To improve its strength, the article may subsequently be subjected to hot isostatic pressing. This improves the mechanical properties (especially fatigue strength) of molded articles.

13 Claims, No Drawings

METHOD AND APPARATUS FOR MANUFACTURING MOLDED ARTICLES OF ALLOYED MATERIAL

This invention relates to method and apparatus for manufacturing molded articles of alloyed material, more particularly of nickel-base alloys, chromium-base alloys, titanium-base alloys, and dispersion-hardened alloys.

Molded articles of nickel-base, chromium-base,and titanium-base alloys are normally manufactured by an investment casting process. Castings, however, exhibit relatively poor mechanical properties especially with respect to fatigue strength, which is of significance for statically or dynamically stressed components, such as rotor blades and nozzle vanes in turbines.

The mechanical properties of such components can be improved by making the part of a suitable wrought or forged alloy. However, complex-section parts, such as turbine rotor blades and nozzle vanes or integral turbine wheels, cannot be manufactured in their final contour by hot or cold forming. In addition, a considerable amount of mechanical or electrochemical machining is needed. Therefore, the manufacture of highly-stressed components for which the strength of casting alloy is inadequate and which are therefore made of a wrought or forged alloy, is encumbered by considerable expense in terms of processing and material lost.

Materials hardened by a particle dispersion process are not of satisfactory quality, regardless of whether cast or forged, for the reason that this process does not provide adequately homogeneous distribution of the particles. The present state of the art includes TD nickel, which is a thorium oxide dispersion hardened nickel material. The manufacturing technology of the material, however, does not permit complex shapes to be obtained at reasonable cost. The major problem encountered is that, as a starting material, use must invariably be made of metal sheet or plate like semi-finishes.

In a broad aspect, the present invention provides method and apparatus for manufacturing molded articles of the type described which overcome the disadvantages of wrought or casting alloys, and more particularly which improve their properties at moderate expense.

It is a particular object of the present invention to provide a method wherein a powder of a suitable alloy, or a mixture of powders of suitable alloy constituents, is mixed with one or more plastics selected from thermoplastics, duroplastics, and internal lubricants to form an injectionable granulate compound which contains about 30% to 50% by volume of the plastic and which is then injection-molded to form a molded article.

More particularly, in the injectionable granulate compound, the plastic is dissolved in a solvent which will not attack the base metal of the alloy, and is mixed with metal powder, after which the solvent is evaporated. The plastic of the injection-molded article is removed at least partially from the molded article by heat treatment at about 600° C. or under in inert gas or in a vacuum. Following removal of the plastic, the molded article is sintered in an inert gas at a temperature of 50% to 90% of the melting temperature of the metal of the alloy. This causes the molded article to shrink, achieving a density of 95% to 98% of theoretical.

In a further advantageous aspect of the present invention, the injection-molded article, if intended for high service stresses, is hot isostatically pressed at a pressure of about 500 to 3000 bar and at the sintering temperature of the metal used. This brings the density of the molded article to nearly 100%, to greatly improve its strength.

Advantageously, the thermoplastics used are polyethylene, polystyrene, polyamide, and/or cellulose and their derivatives; the duroplastics used are epoxy resins, phenolic resins and/or polyamides; and the plastic internal lubricants used are stearic acid, stearates, and/or waxes.

For molded articles made of a nickel-base alloy, a titanium-base alloy, or a chromium-base alloy, the starting powder or mixture is preferably low in carbon, since most binders are known to leave free carbon behind, which might impair the properties of the molded article when the binders are being eliminated by heat treatment. Use of a base material low in carbon, therefore, keeps the carbon content of the molded article within allowable limits despite the carbon left behind by the binders.

For molded articles of nickel, titanium, or chromium base alloys, the binders used are preferably polyethylenes and stearates, which after heat treatment or removal of the plastic leave little carbon behind, to combat the problem mentioned above. The problem is overcome, in a further aspect of the present invention, when elimination of the plastic by heat treatment is followed by hydrogen heat treatment, with the pressure set at 1 to 300 bar and the temperature at about 400° to 1000° C.

The method of the present invention can be modified such that the sintering process is followed by heat treatment intended to adjust the grain size of the material to best suit the molded component.

An apparatus designed for implementing the method of the present invention is characterized by those parts of the apparatus that experience wear from the frictional effect of the injectionable granulate compound being formed from the same material as the alloy to be processed, or being coated with that alloy. This protects the alloy from being contaminated during manufacture.

The invention improves the fatigue strength of the material. It also permits the manufacture of complex components of highly intricate final contours, such as rotor blades and nozzle vanes of turbines or integral turbine wheels. After injection-molding, the resulting molded article requires little if any subsequent mechanical or electrochemical machining. It is especially the drastic reduction in machining effort which distinguishes this simple manufacturing process, and its high-quality product, from the previously-mentioned manufacturing processes for shaped-section components.

The invention will now be described more fully. The starting material is a powder of a suitable alloy or of a blend of powders of alloy constituents. This powder is prepared with the aid of thermoplastics, duroplastics, and internal lubricants to form an injectionable compound. The compound contains plastic in the amount of 30% to 50% by volume.

The plastics which may be used are the following:

thermoplastics: polyethylene, polystyrene, polyamide, cellulose, and their derivatives duroplastics: epoxy resins, phenolic resins, polyamides internal lubricants: stearic acid, stearates, waxes.

The plastics selected are dissolved in a solvent which will not attack the metals and is blended with the metal powder. The solvent is then evaporated, and the compound is conditioned to form an injectionable granulate. This granulate is then injection molded to form the molded article.

After injection molding, the plastic is eliminated from the molded article by heat treatment at 600° C. or less in an inert gas. The part is then sintered in an inert gas or in a vacuum at 50% to 90% of the melting temperature of the metal used. This causes the part to shrink linearly by an amount of 10% to 25% for an ultimate density of 95% to 98% of theoretical maximum density.

When parts are intended for high service stresses, hot isostatic pressing (pressure: 500 bar to 3000 bar, and temperature as for sintering) can be used to bring the density to very nearly 100% for considerably improved strength.

The method lends itself for use primarily with the following alloys:

nickel-base alloys,
chromium-base alloys,
titanium-base alloys, and
dispersion-hardened alloys.

The method will have to be modified to best suit the type of alloy and achieve optimum results.

NICKEL-BASE ALLOYS

The main problem with nickel-base alloys is that most binders will leave free carbon behind when being eliminated by heat treatment. The carbon may compromise the properties of the molded article. In order to combat the problem, the following counter-measures are indicated:

- Use of a starting powder that is low in carbon, keeping the carbon content of the part within allowable limits despite the carbon remaining behind;
- Use of binders that leave little carbon behind, such as polyethylenes and stearates;
- Hydrogen heat treatment after removal of the binder under heat, at a pressure of 1 to 300 bar and a temperature of 400° to 1000° C.;
- For alloys low in carbon, it will be helpful to heat treat after sintering. The carbon from the binder is distributed non-homogeneously and tends to appear at places which before sintering were the surfaces of powder grains. Heat treatment distributes the carbon homogeneously.

TITANIUM ALLOYS

As was the case with nickel-base alloys, the binders may release carbon which compromises the mechanical strength of the finished products. For generally adequate mechanical strength of the material, the starting powder is low in carbon to compensate for the excessive carbon content of the binders, thereby keeping the carbon portion of the molded article within allowable limits despite the amount of carbon left behind by the binder (cf. nickel-base alloys).

When being heated for elimination of the binder, the latter releases hydrogen. Hydrogen readily dissolves in titanium alloys and compromises their strength. It must be removed under heat using conventional procedures in a vacuum or in an inert gas.

Titanium alloys will readily oxidize. All process operations taking place at temperatures above room temperature should best be performed in a vacuum or in an inert gas. This especially includes the blending of the compound and its injection into molds. Use is preferably made of conventional blenders. For injecting, use is preferably made of evacuated injection-molding machines.

CHROMIUM ALLOYS

Chromium alloys strongly resemble nickel-base alloys as regards chemical properties, so that they pose the same problems. To overcome the problem of free oxygen, the countermeasures are the same as were indicated for the nickel-base alloys.

DISPERSION-HARDENED ALLOYS

The dispersion-hardened alloys are two-phase or multi-phase materials the matrix of which consists of an oxidation-resistant, mostly single-phase alloy. Embedded in the matrix are particles of a second phase (or of several phases).

Dispersion-hardened alloys are characterized by the fact that the particles cannot be dissolved in the matrix. The particles cause the material to harden. The merit of dispersion-hardened alloys is their resistance to aging at elevated temperatures, because of the insolubility of the second phase.

In the manufacture of such alloys, two major difficulties need be overcome:

the particle should be as small as possible (1 μm)
the particles should be homogeneously distributed in the matrix.

The particles are normally added to the melt of the matrix alloy. The one disadvantage characterizing this process is that owing to differences in the density of the matrix and of the particles, concentration gradients will result when the melt is poured. Forces of adhesion will additionally cause the particles to lump together. The distribution of particles will altogether be rather less than ideal. Homogenization by plastic deformation is prevented, since the plastic deformability of the known alloys is inadequate for the purpose.

The method of the present invention will give a very homogeneous distribution of the particles. The particles are added to the matrix powder and blended with it. Considering that no melting phase occurs during the entire process, separation or formation of gradients is prevented. Nor will the distribution suffer at the time the compound is conditioned and injection-molded, when it would in fact rather tend to benefit. The very homogeneous distribution of particles achieved by the method gives better strength of the molded article than would conventional manufacturing processes.

In order to prevent contamination in processing, the method can be modified as follows:

Those parts of the blender (container and agitating bars) and of the injection-molding machine (worm gear, cylinder, backflow baffle, nozzle) that are subject to wear by frictional contact with the compound, are made of or coated with the material of the alloy to be processed. Use can also conceivably be made of similar alloys, or merely one or several alloy constituents that would be particularly suitable for the purpose.

With alloys containing carbon the binder can be utilized as a carbon donor. The sintering process can be followed by heat treatment intended to adjust the grain size to suit the application of the molded article.

Injection-molding can utilize inserted lost cores consisting of a material that will decompose at the time the binder is removed under heat (illustrative core materials are plastics, preferably duroplastics, possibly carbon fiber reinforced). The use of cores will readily permit manufacture of complex cooling configurations in turbine blades, and other appropriate parts.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A method of manufacturing a molded article of metal alloy material, comprising the steps of:

providing a granulate mixture of metal alloy powder and a plastic binder, the plastic binder being between 30% and 50% by volume of the mixture, injection molding the mixture to form a molded article, subjecting the molded article to a first heat treatment at a temperature no higher than 600° C., in an atmosphere of an inert gas or in a vacuum, to at least partially remove the plastic, carbon remaining in the molded article as a result of this heat treatment, thereafter subjecting the molded article to a second heat treatment, in an atmosphere of hydrogen, at a pressure of 1-300 bar, and at a temperature of between 400° and 1000° C., to thereafter sintering the molded article.

2. A method as defined in claim 1 wherein the alloy powder includes one or more alloys selected from the group consisting of nickel-base alloys, chromium-base alloys, titanium-base alloys, and dispersion-hardened alloys.

3. A method as defined in claim 1 wherein the plastic is one or more of a thermoplastic, a duroplastic, and an internal lubricant.

4. A method as defined in claim 1 wherein the granulate compound is prepared by dissolving the plastic in a solvent which will not attack the base metal of the alloy, mixing the dissolved plastic with the alloy powder, and thereafter evaporating the solvent.

5. A method as defined in claim 1 wherein after at least partial removal of the plastic, the molded article is sintered in an inert gas or in a vacuum at a temperature between 50% and 90% of the melting temperature of the base metal of the alloy powder.

6. A method as defined in claim 1 wherein sintering is accomplished by hot isostatically pressing the molded article at a pressure between 500 to 3000 bar and at the sintering temperature of the base metal of the alloy.

7. A method as defined in claim 3 wherein the thermoplastic is selected from the group consisting of polyethylene, polystyrene, polyamide, and cellulose, and their derivatives.

8. A method as defined in claim 3 wherein the duroplastic is selected from the group consisting of epoxy resins, phenolic resins, and polyamides.

9. A method as defined in claim 3 wherein the internal lubricant is selected from the group consisting of stearic acid, stearates, and waxes.

10. A method as defined in claim 7 wherein the alloy powder includes one or more alloys selected from the group consisting of nickel-base alloys, chromium-base alloys, and titanium-base alloys, the alloy powder being low in carbon.

11. A method as defined in claim 1 wherein the alloy powder includes one or more alloys selected from the group consisting of nickel-base alloys, chromium-base alloys, and titanium-base alloys, and the plastic binder is one which when at least partially eliminated from the molded article by heat treatment leaves little carbon behind.

12. A method as defined in claim 11 wherein the plastic binder is a polyethylene or a stearate.

13. A method as defined in claim 5 wherein after sintering, the molded article is heat treated to adjust the grain size of the material of the article.

* * * * *